US006880672B2

(12) United States Patent
Imberi

(10) Patent No.: US 6,880,672 B2
(45) Date of Patent: Apr. 19, 2005

(54) SELF PROPELLED SCAFFOLDING

(76) Inventor: Robert Imberi, 259 S. Sunset Dr., Mina, SD (US) 57451

( * ) Notice: Subject to any disclaimer, the term of this patent is extended or adjusted under 35 U.S.C. 154(b) by 0 days.

(21) Appl. No.: 10/419,069

(22) Filed: Apr. 18, 2003

(65) Prior Publication Data

US 2003/0230450 A1 Dec. 18, 2003

Related U.S. Application Data

(60) Provisional application No. 60/373,587, filed on Apr. 18, 2002.

(51) Int. Cl.[7] ..... E04G 3/16

(52) U.S. Cl. ..... 182/13; 182/16; 182/63

(58) Field of Search ..... 182/13, 16, 63, 182/141, 148, 178, 129

(56) References Cited

U.S. PATENT DOCUMENTS

| | | | | | |
|---|---|---|---|---|---|
| 3,232,375 | A | | 2/1966 | Warthen | 182/13 |
| 3,256,954 | A | | 6/1966 | Warthen | 182/13 |
| 3,422,922 | A | | 1/1969 | Aiken | 182/14 |
| 3,502,172 | A | | 3/1970 | Ismond | 182/16 |
| 3,596,735 | A | | 8/1971 | Denier | 182/63 |
| 3,731,758 | A | * | 5/1973 | Hibma | 180/11 |
| 3,817,346 | A | * | 6/1974 | Wehmeyer | 182/14 |
| 3,858,688 | A | * | 1/1975 | Galloway | 187/224 |
| 3,865,203 | A | | 2/1975 | Hibma | 180/2 |
| 3,930,548 | A | | 1/1976 | Wallraff | 180/6.5 |
| 3,961,681 | A | | 6/1976 | Fisher | 180/66 |
| 4,026,519 | A | * | 5/1977 | Piercy | 254/2 R |
| 4,053,025 | A | | 10/1977 | Slusarenko | 180/2 |
| 4,088,202 | A | | 5/1978 | Costello | 182/13 |
| 4,275,797 | A | * | 6/1981 | Johnson | 180/65.1 |
| 4,340,130 | A | * | 7/1982 | Payne et al. | 182/186.9 |
| 4,475,611 | A | | 10/1984 | Fisher | 180/6.5 |
| 4,909,350 | A | * | 3/1990 | Jacobs | 182/82 |
| 4,967,733 | A | | 11/1990 | Rousseau | 182/13 |
| 5,447,479 | A | * | 9/1995 | Gvoich | 482/54 |
| 5,525,884 | A | * | 6/1996 | Sugiura et al. | 318/587 |
| 5,722,506 | A | | 3/1998 | Takai | 182/16 |
| 5,875,869 | A | | 3/1999 | Busuttil et al. | 182/69.6 |
| 6,109,390 | A | * | 8/2000 | Giannopoulos | 182/16 |
| 2002/0096394 | A1 | * | 7/2002 | Chick | 182/16 |
| 2004/0035636 | A1 | * | 2/2004 | Julien | 182/69.6 |

FOREIGN PATENT DOCUMENTS

| | | | | |
|---|---|---|---|---|
| DE | 3543010 | * | 6/1987 | 182/13 X |
| GB | 2332405 | * | 6/1999 | 182/13 X |
| JP | 144783 | * | 5/1994 | 182/13 X |
| WO | WO 99/41186 | * | 8/1999 | 182/13 X |

* cited by examiner

*Primary Examiner*—Bruce A. Lev
(74) *Attorney, Agent, or Firm*—Vidas, Arrett & Steinkraus

(57) ABSTRACT

A light-weight self-propelled scaffold vehicle is guidable through the use of a toggle switch. It is dimensioned and designed to be able to be utilized in small areas and through 30 inch doorways as well as for larger areas.

24 Claims, 22 Drawing Sheets

SELF PROPELLED SCAFFOLDING

CROSS-REFERENCE TO RELATED APPLICATIONS

This application claims the benefit of Provisional Application 60/373,587 filed Apr.18, 2002 which is incorporated by reference herein in its entirety.

STATEMENT REGARDING FEDERALLY SPONSORED RESEARCH

Not Applicable

FIELD OF THE INVENTION

This invention relates to a light-weight self-propelled scaffold vehicle. This invention is guidable through the use of a toggle switch and it is dimensioned and designed to be able to be utilized in small areas and through 30 inch doorways as well as for larger areas.

BACKGROUND

Mobile scaffolds have been used to transport workers and their materials from one work location to another. They provide means for working at heights commensurate with the elevation of the work being done. Rather than working from a ladder and then having to move the ladder and work material from one location to another, these scaffolds have provided for means to move the materials and platform in a convenient manner. For those instances in which the movements necessary are only a couple of feet at a time (e.g. painting or tiling a ceiling), these scaffolds save time and the frustration of having to continually step down from a ladder and move it and the materials a few feet over.

All US patents and applications and all other published documents mentioned anywhere in this application are incorporated herein by reference in their entirety.

The invention in various of its embodiments is summarized below. Additional details of the invention and/or additional embodiments of the invention may be found in the Detailed Description of the Invention below.

The abstract provided herewith is intended to comply with 37 CFR 1.72 and is not intended to be used in determining the scope of the claimed invention.

SUMMARY OF THE INVENTION

The present invention is directed to a scaffold which is designed for its ease of use and light weight. It allows for one-person operation, assembly and disassembly, and transportation from one job site to another. While this invention may be embodied in many different forms, there are shown in the drawings and described in detail herein specific embodiments of the invention. The present disclosure is an exemplification of the principles of the invention and is not intended to limit the invention to the particular embodiments illustrated.

In at least one embodiment a lightweight self-propelled scaffold unit comprises a base frame with removably attached end rails extending vertically with a drive motor battery powering a drive motor and a steering motor battery powering a steering motor. In at least one embodiment a pair of rear wheels is driven by the drive motor. In at least one embodiment a pair of front wheels is used in steering such that they are rotated by action of the steering motor;

In at least one embodiment a large drive sprocket is disposed about a rear wheel axel.

In at least one embodiment the large drive sprocket communicates with a small drive sprocket driven by the drive motor.

In at least one embodiment the small drive sprocket communicates with the large drive sprocket via a chain or belt.

In at least one embodiment the drive motor is operated by a toggle switch.

In at least one embodiment the steering motor is operated by a toggle switch.

In at least one embodiment the drive motor and the steering motor are operated by a single toggle switch.

In at least one embodiment the end rails have horizontal bars upon which moveable platforms can be placed.

In at least one embodiment the drive motor, steering motor, drive motor battery, and/or steering motor battery are located under the lowest platform level.

In at least one embodiment the base frame is made of angle iron.

In at least one embodiment the base frame is made of a metal chosen from the group consisting of titanium, aluminum, steel, and composites thereof.

In at least one embodiment the base frame is made of a plastic.

In at least one embodiment the end rails are made of a metal from the group titanium, aluminum, steel, and composite thereof.

In at least one embodiment the end rails are made of a plastic.

In at least one embodiment the end rails are mated to the frame such that the ends of the frame decrease in width or diameter so as to fit into the space of the frame.

In at least one embodiment the batteries are 12V batteries.

In at least one embodiment the drive motor is a 12V motor.

In at least one embodiment the platform is a metal, plastic, wood, or combination thereof.

In at least one embodiment the base frame is rectangular.

In at least one embodiment the base frame is constructed of oval, circular, rectangular, triangular, polygonal or any combination thereof shaped material.

In at least one embodiment the end rails are constructed of oval, circular, rectangular, triangular, polygonal or any combination thereof shaped material.

In at least one embodiment the drive motor comprises a switch with an on position and an off position. In at least one embodiment, when the switch is in the on position and the motor communicates with a power source, the drive motor can drive the small sprocket. In at least one embodiment, when the switch is in the off position, the motor will not drive the small sprocket.

In at least one embodiment the unit includes a clutch mechanism having an engaged and an unengaged position. In the engaged position the drive motor can power the large motor sprocket, and in the unengaged position the drive motor cannot power the large motor sprocket.

They are used for both propulsion and steering and allows for one person operation inside and outside a building. However, steering wheels and levers are also contemplated as suitable steering mechanisms. So too, the use of throttles or foot pedals are contemplated as suitable propulsion mechanisms. The dimensions of this invention allow it to travel through regularly sized residential doors without disassembly, and its light weight allows for its use on ½ inch plywood floors. Its assembly and disassembly is such that it can be done by one person, and its dimensions and weight are such that it can be hauled on a lightweight trailer, back of a pick-up, or inside a van. The invention is wholly powered by two 12 V batteries that power a 12 V motor. It thereby eliminates the need for electric cords that can get in the way of the scaffold.

Without limiting the scope of the invention in any way, the invention is further described in some of its aspects below.

BRIEF DESCRIPTION OF THE DRAWINGS

A detailed description of the invention is hereafter described with specific reference being made to the drawings in which.

DETAILED DESCRIPTION OF THE INVENTION

Figure 1A:
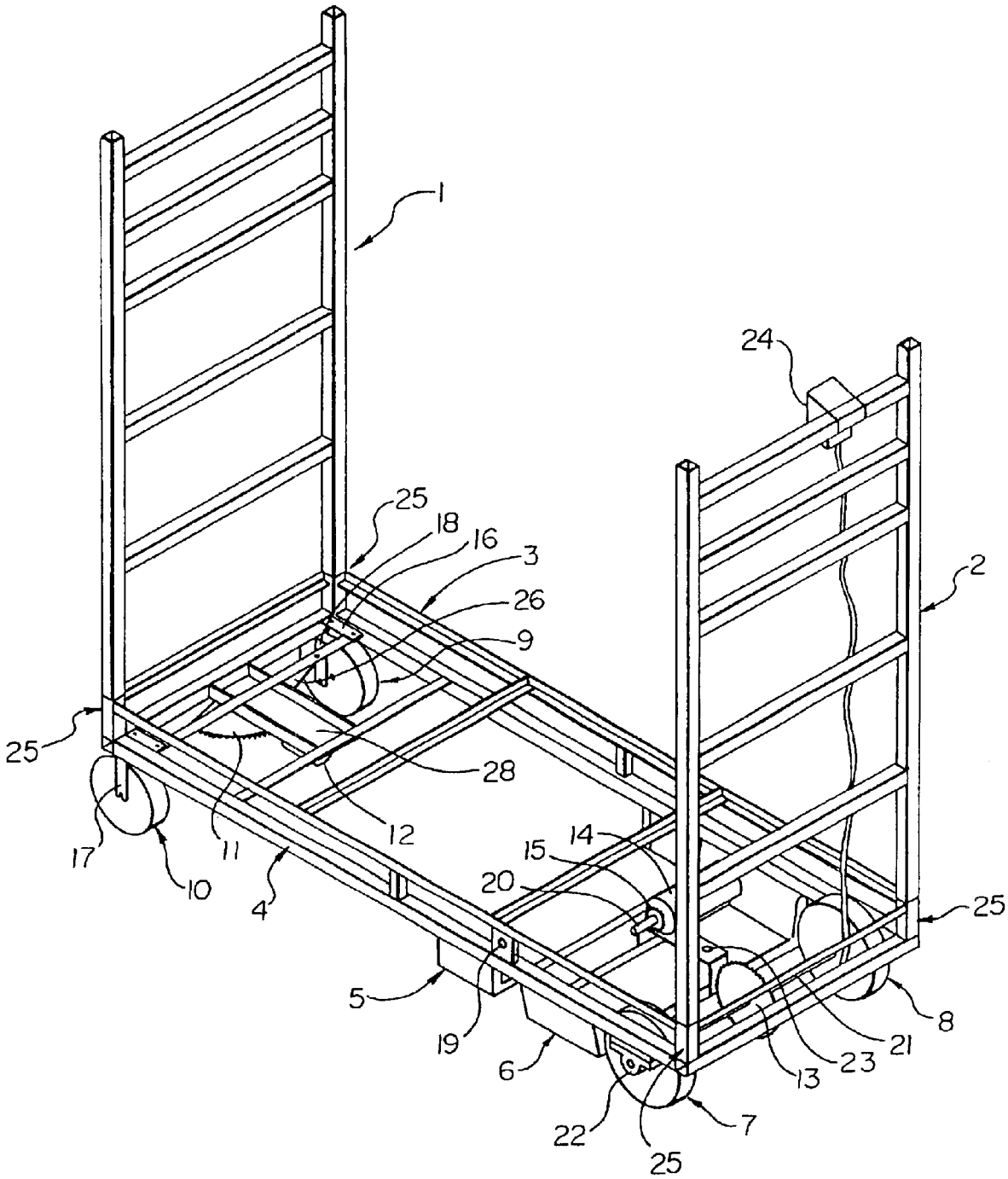
FIG. 1*a* a is a perspective view of a motorized scaffold with an independent steering mechanism.
Figure 1B:
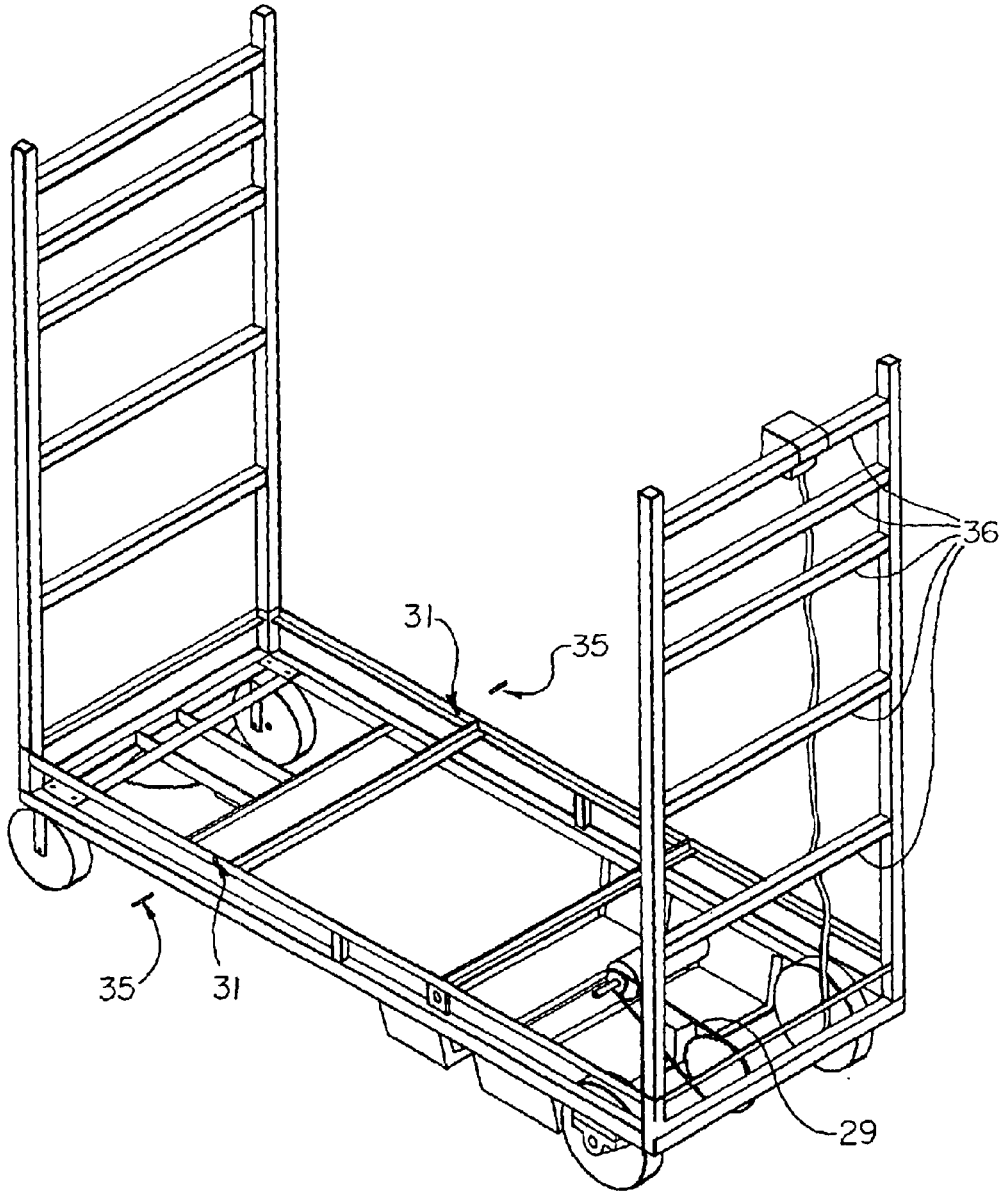
FIG. 1b is an unbidden perspective view of the motorized scaffold.
Figure 2:
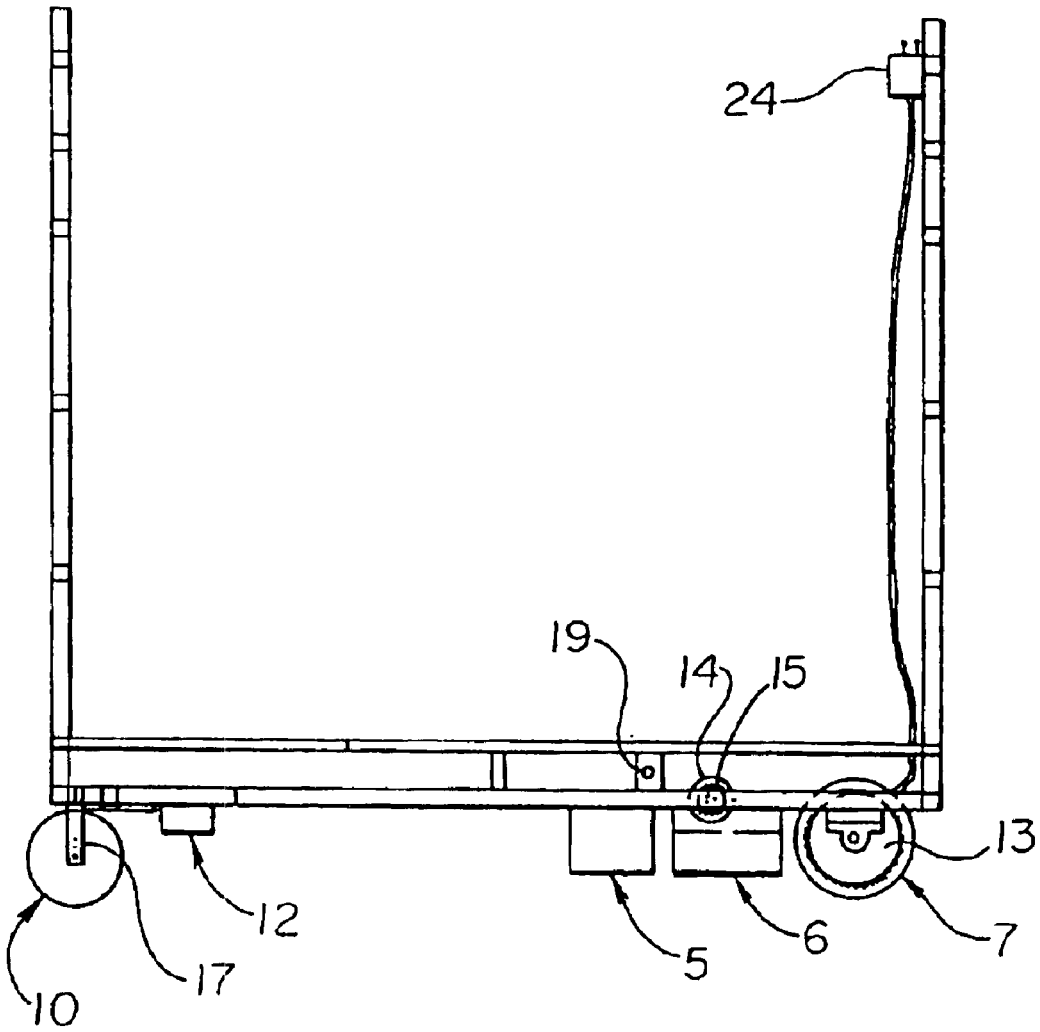
FIG. 2 is a side view of the scaffold with the main platform at its lowest level.
Figure 3:
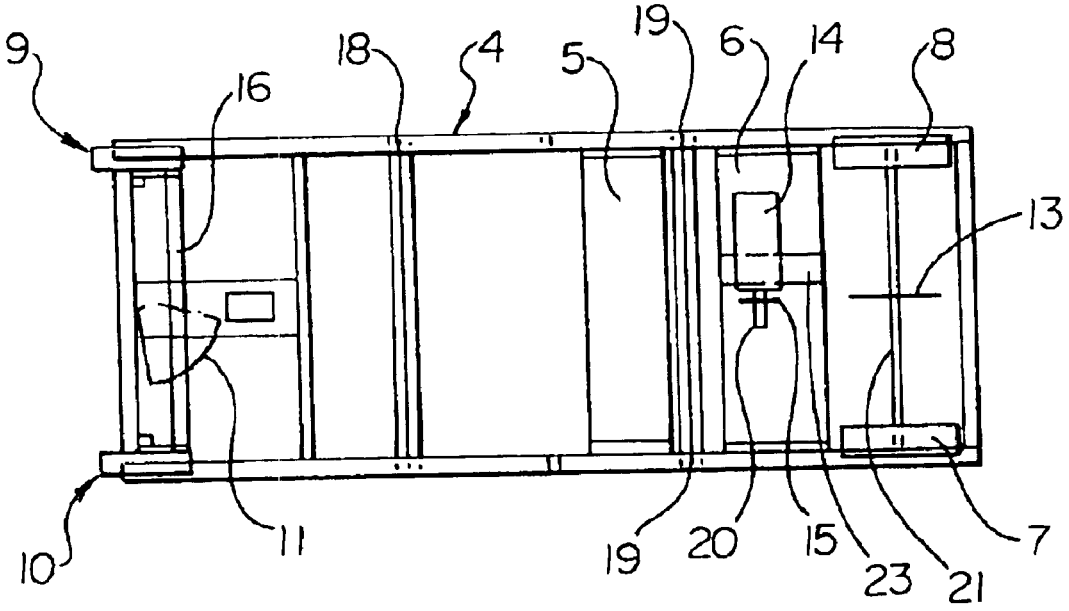
FIG. 3 is a top view of the scaffold with battery trays and drive motor.

While this invention may be embodied in many different forms, there are described in detail herein specific embodiments of the invention. This description is an exemplification of the principles of the invention and is not intended to limit the invention to the particular embodiments illustrated.

For the purposes of thus disclosure, unless otherwise indicated, identical reference numerals used in different figures refer to the same component.

Referring now to the drawings, FIGS. 1*a*, 1*b*, 2, and 3 show a scaffold unit having forward end rail 1 and rear end rail 2 at the ends of the scaffold unit. The end rails may be removably engaged to the frame 4. A support rail 3 may be mounted above the frame 4. This is where a main platform may be placed. The platform may be of one piece or several different pieces.

The frame 4 may hold the end rails in place at end comers having slots 25. End rails may also be engaged to the frame 4 at many different locations along the length of the frame 4. This allows lighter and weaker platform portions to be used in that the weight bearing points are closer together. The end rails may also be engaged to slots 25 which can be slid along the length of the frame 4 and the support rail 3 utilizing friction reducing devices such as rollers, graphite, lubricants, etc. The end rails can then be locked into position with pegs 35 that may pass through the support rail 3 and a portion of the sliding slots 25. The support rails 3 may also have locking positions 31 which may be holes in the support rail 3 that match locking nub portions 33 shown in FIG. 4. These nub portions 33 may pass through slot 25 and into the frame locking position 31. These nub portions 33 may be spring loaded such that they may recede within the end rails when not positioned at a frame locking position 31. At the frame locking position 31 the nub portion is allowed to extend into the frame locking position 31. It should be noted that the nub portion may also extend from the frame into a hole in the end rail.

In the rear of the frame, pillow bearings 22 are mounted on each end of the frame 4 to support the rear axel 21. The support rail 3 may be made of angle iron.

Figure 6:
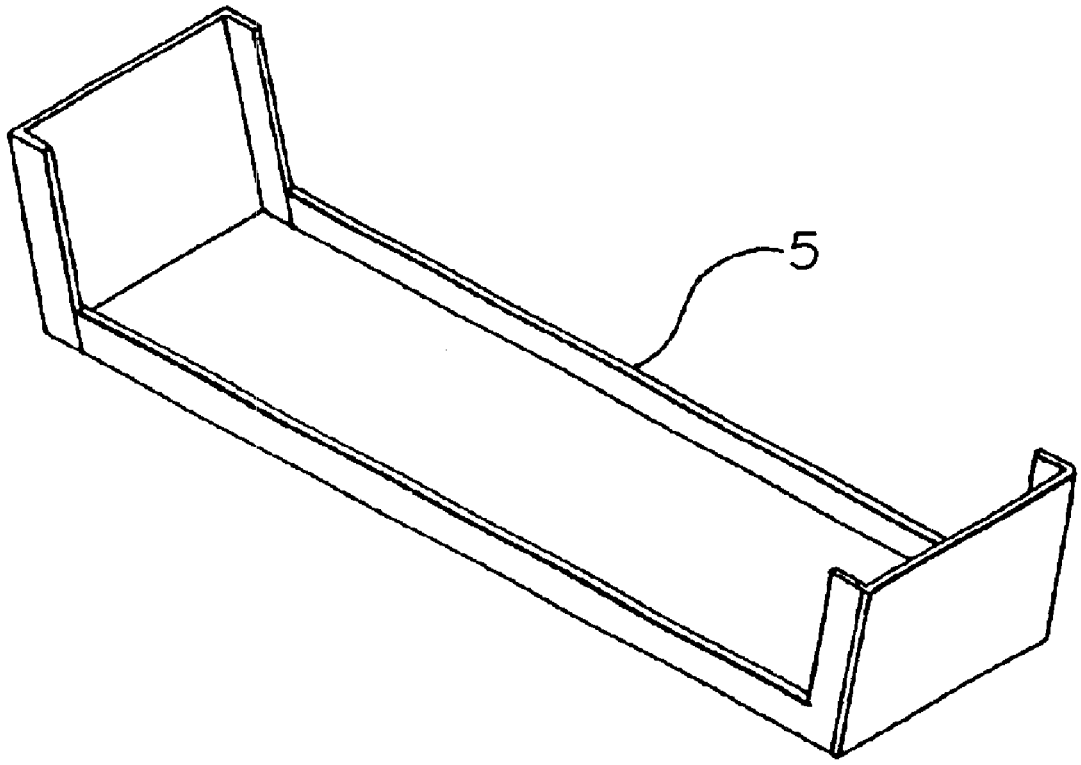
FIG. 6 is a perspective of the big battery tray.

Drive battery tray 5 and/or steering battery tray 6 may be positioned below the main frame 4. Drive battery tray 5 as illustrated in FIG. 6 may hold the drive motor battery 35 used for the propulsion unit 14. Steering battery tray 6 may hold the steering motor battery 37 used for the steering motor 12. Both drive motor battery 35 and steering motor battery 37 may be 12 volt batteries.

Figure 9:
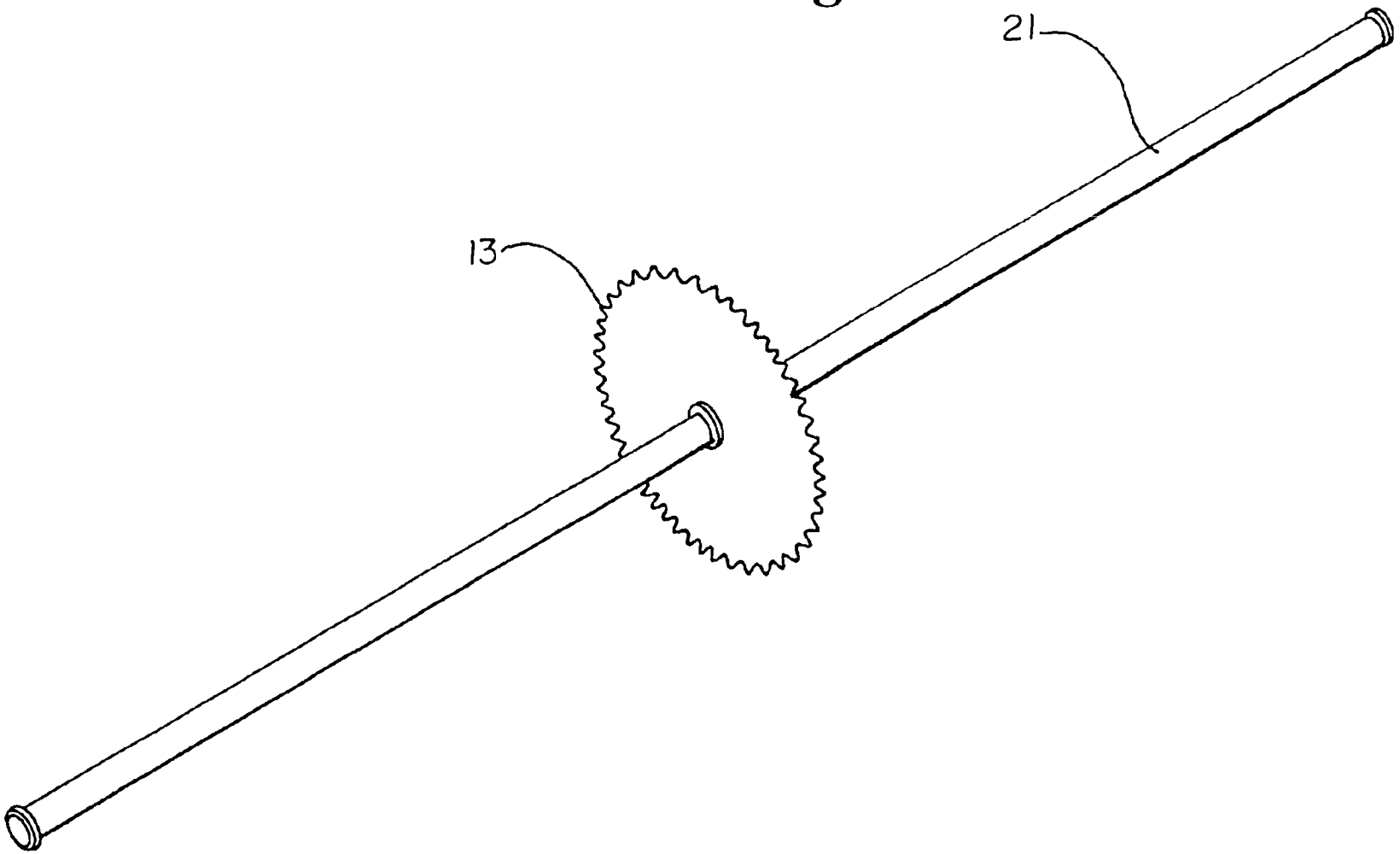
FIG. 9 is a detail of the rear wheel axel.

The rear wheels 7 and 8 are attached to the rear axle 21 shown in FIG. 9. The rear axle includes a large drive sprocket 13. The drive sprocket 13 may be driven by a chain or belt 29 by drive motor 14 and drive shaft 20, which drives small sprocket 15. The drive motor 14 may have an on/off switch 19. When the switch 19 is in the on position and electric power or current is flowing to it, the motor 14 will run. In the off position the motor is designed not to run.

Figure 4A:
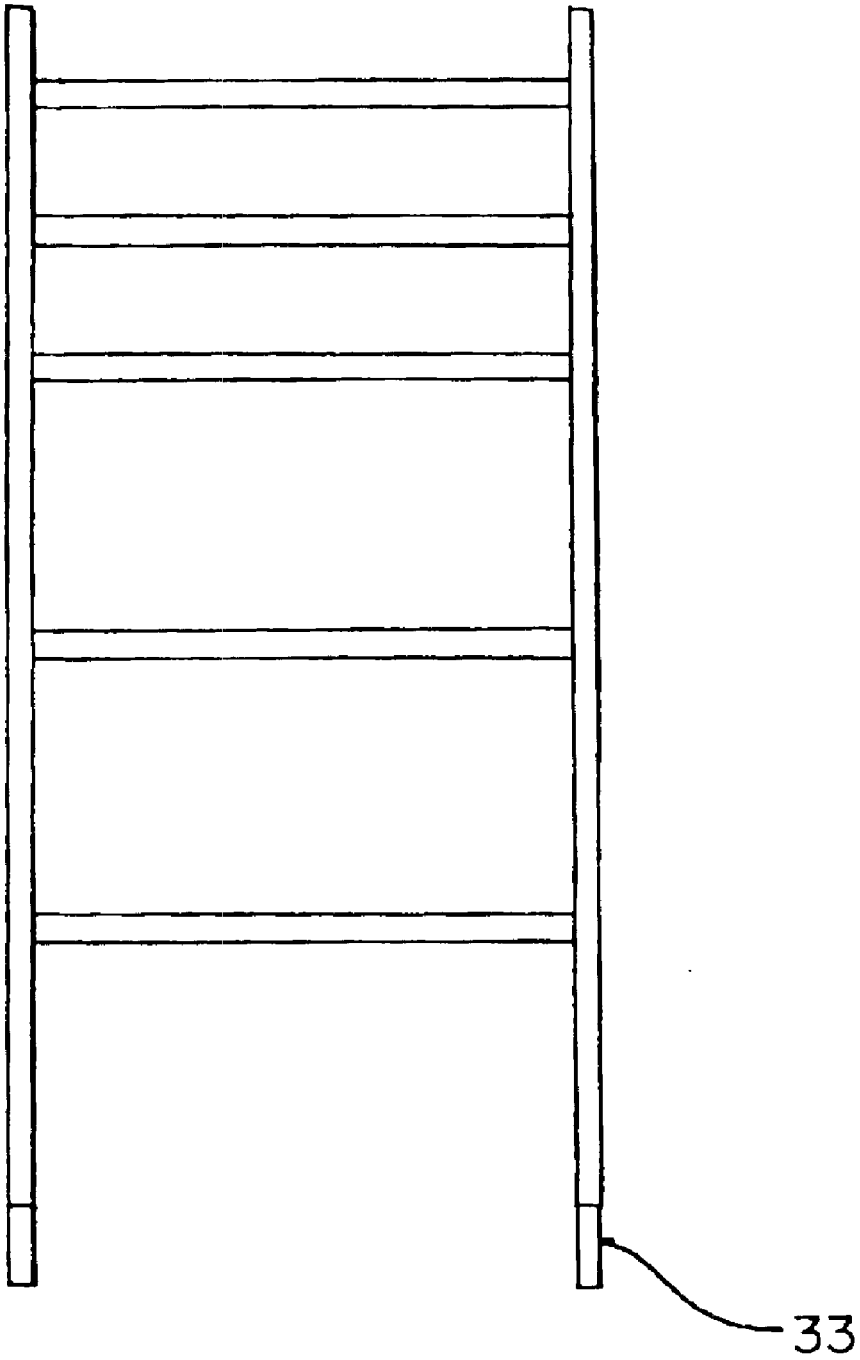
FIG. 4*a* is a front view of the scaffold rails that mount on each end.
Figure 4B:
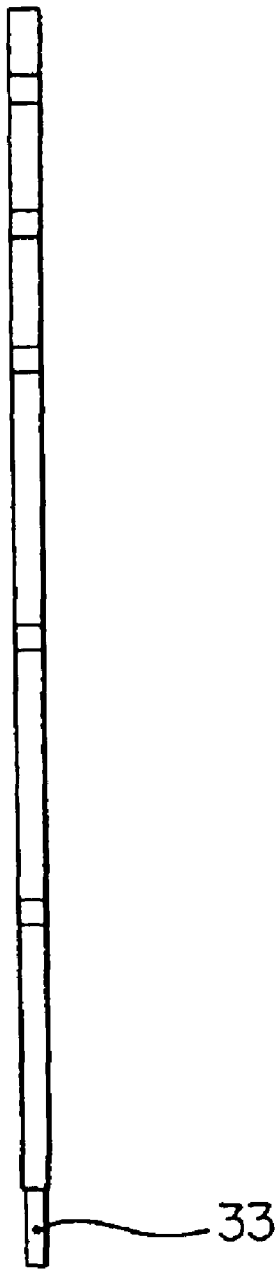
FIG. 4*b* is a side view of the scaffold rails that mount on each end.
Figure 4C:
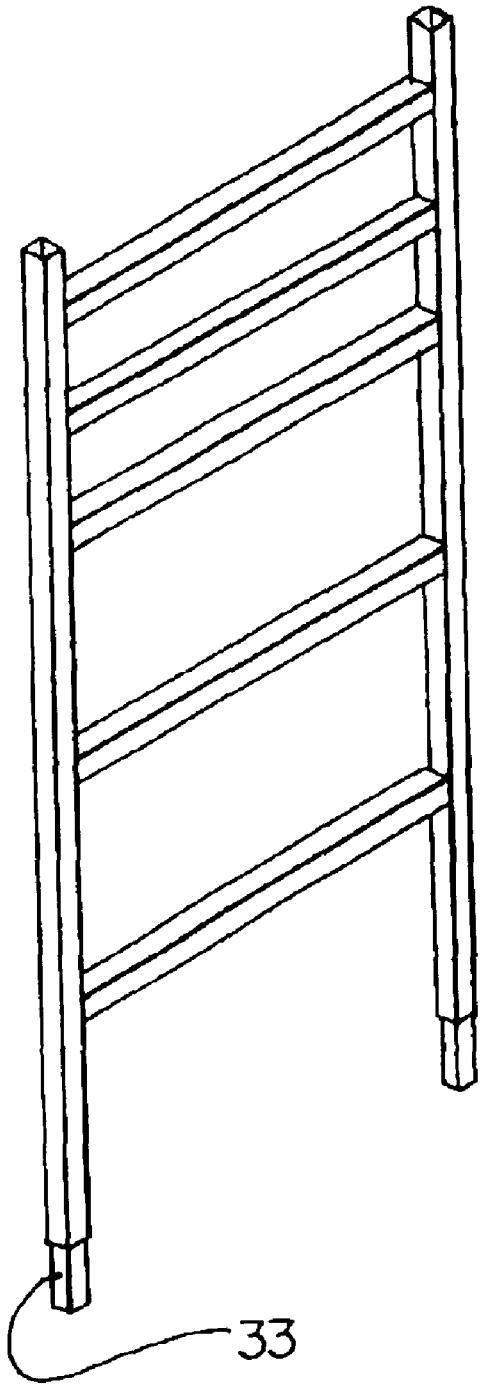
FIG. 4*c* is a perspective view of the scaffold rails that mount on each end.
Figure 5:
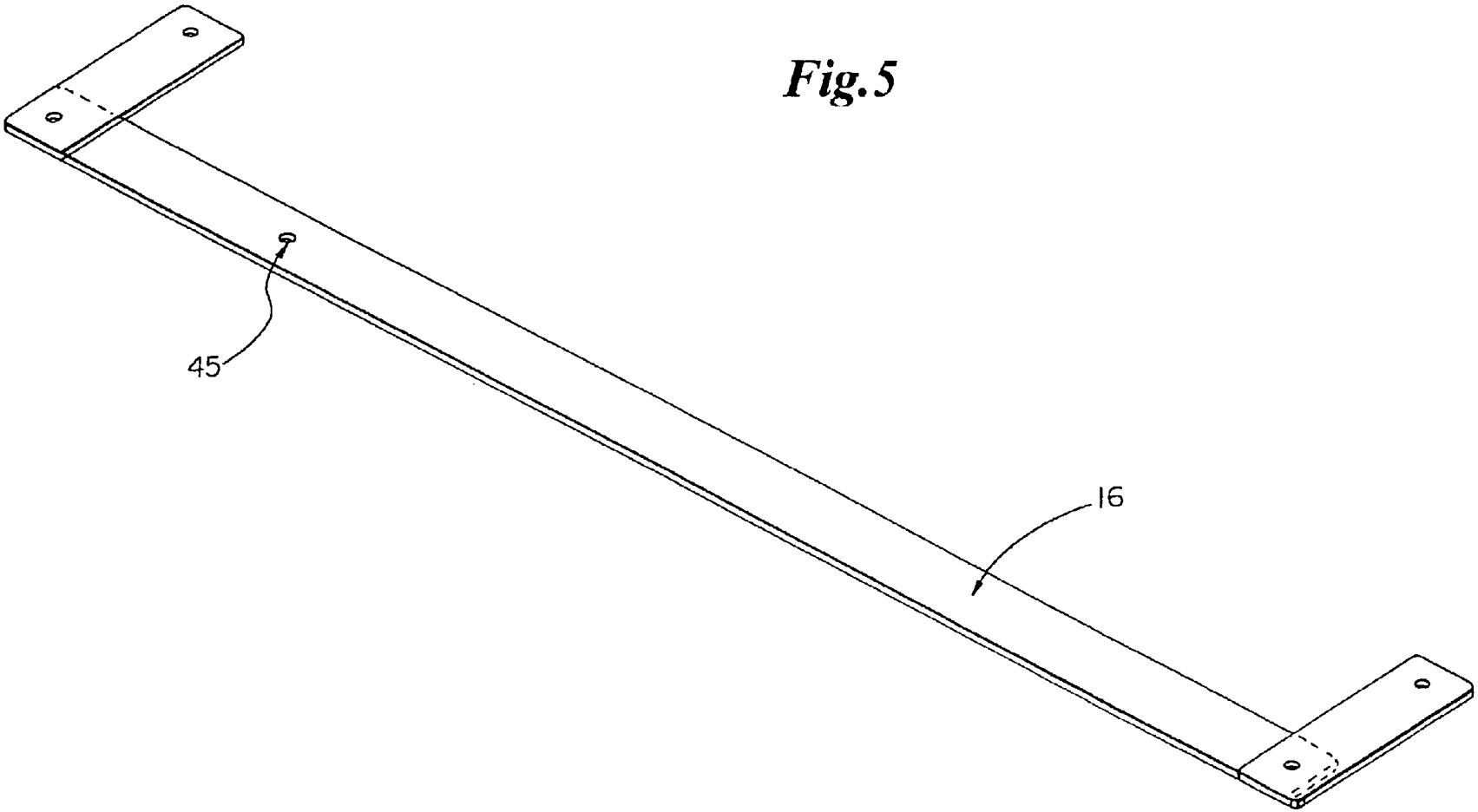
FIG. 5 is a view of the front wheel steering bracket that mounts to the front tire forks.
Figure 7:
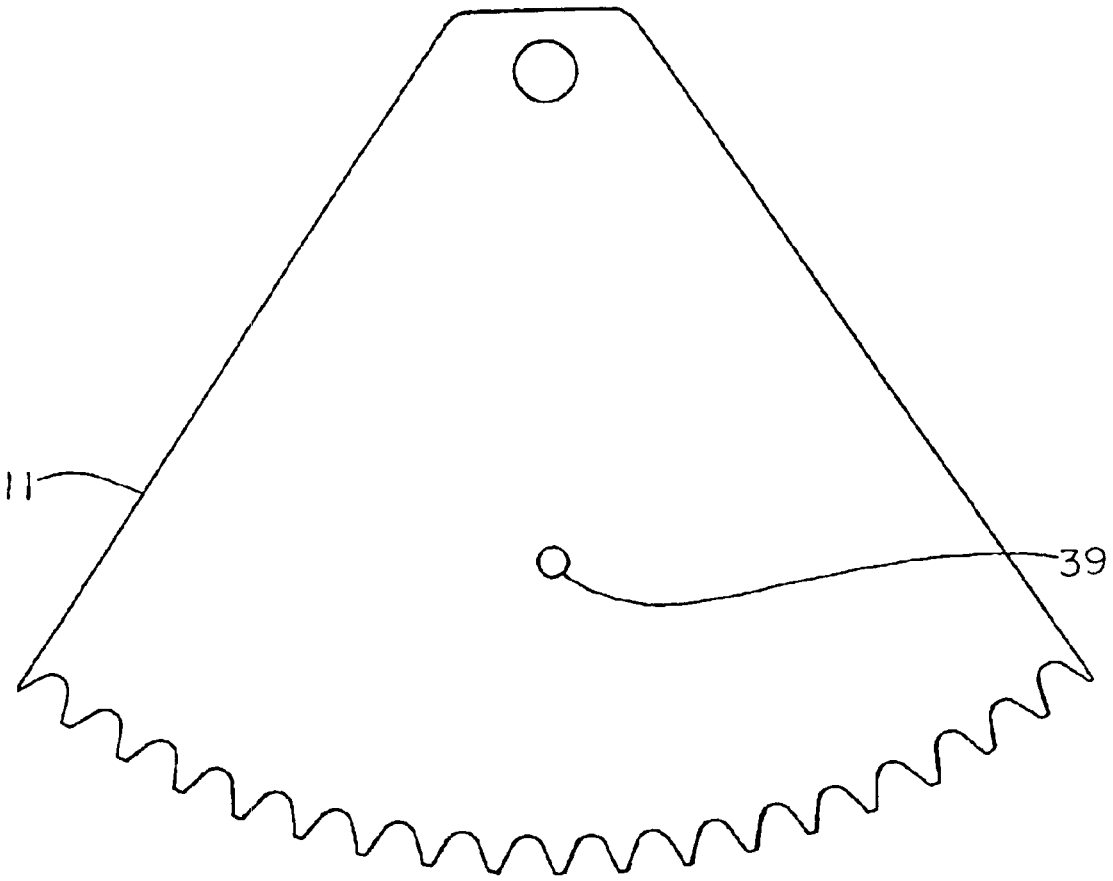
FIG. 7 is a detail of the front wheel steering sprocket.
Figure 8:
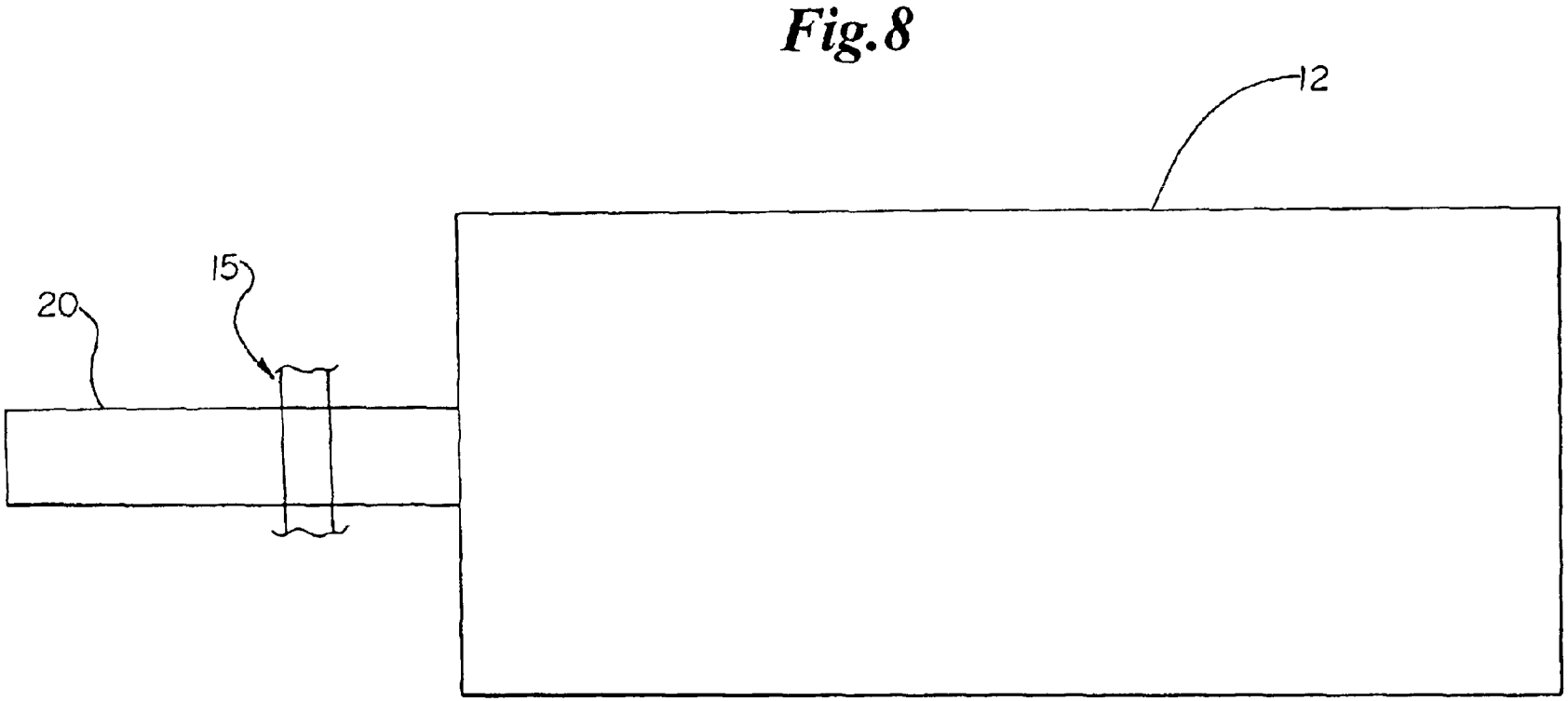
FIG. 8 is a detail of the main drive motor for the back wheels.
Figure 10:
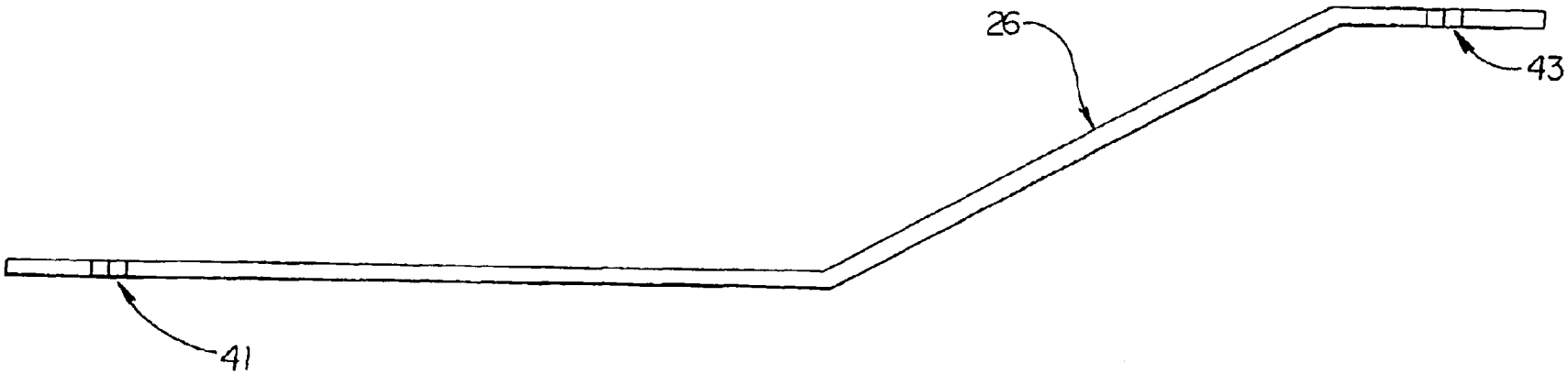
FIG. 10 is a detail of the rear wheel steering arm is a detail of the rear wheel axel.

Steering may be performed by turning front wheels 9 and 10 by rotating the front wheel forks 17. These wheels are attached to the front wheel forks 17. The frame rests upon and is attached to these wheels 9 and 10 through the use of casters. FIG. 7 illustrates the front wheel steering sprocket 11. The front wheel steering sprocket 11 is controlled through a toggle switch 24 that communicates with 12V steering motor 12 as illustrated in FIG. 8. The steering motor 12 rotates front wheel steering sprocket 11, which acts on front wheel steering arm 26 shown in FIG. 10, which in turn acts on front wheel steering bracket 16 shown in FIG. 5. Movement of front wheel steering bracket 16 results in the turning of wheels 9 and 10. In at least one embodiment, the front wheel steering sprocket 11 has a bore 39 as shown in FIG. 7 which matches bore 41 of the front wheel steering arm 26 shown in FIG. 10. Through connection means, such as a bolt through bore 41 and bore 39, the arm 26 and sprocket 11 are engaged such that movement of the sprocket 11 results in movement of the arm 26. Bore 45 of front wheel steering bracket 16 in FIG. 5 matches second bore 43 of steering arm 26. Again through connection means, such as a bolt through second bore 43 and bore 45, the arm 26 and bracket 16 are engaged such that movement of the arm 26 results in movement of the bracket 16. With movement of the bracket 16 the front wheels may turn FIG. 4 illustrates an embodiment of the scaffold rails 1 and 2. The scaffold rails 1 and 2 may have crossties 36 which are at varying heights above the frame 4 and may be substantially parallel to the frame 4. The scaffold rails 1 and 2 may have the same number of crossties 36 and each crosstie 36 on rail 1 may be equidistant from the frame as each corresponding crosstie 36 of rail 2. The rails fit into the frame 4 by reducing the width of the rails at their ends so they fit snugly into the slots 25 within the frame 4. The width of the rails may be reduced to 1.125 inches to match the openings of the slots 25 which may be sized to just greater than 1.125 inches. Boards may be placed on the crossties 36 of the rails in order to stand on them or place items onto the boards. A board may even be placed at a slant such that the front end of the board and the rear end of the board rest on crossties that are at different heights from the frame 4. Board as used in this application may be any material which has two substantially flat surfaces substantially parallel to one another.

Figure 11:
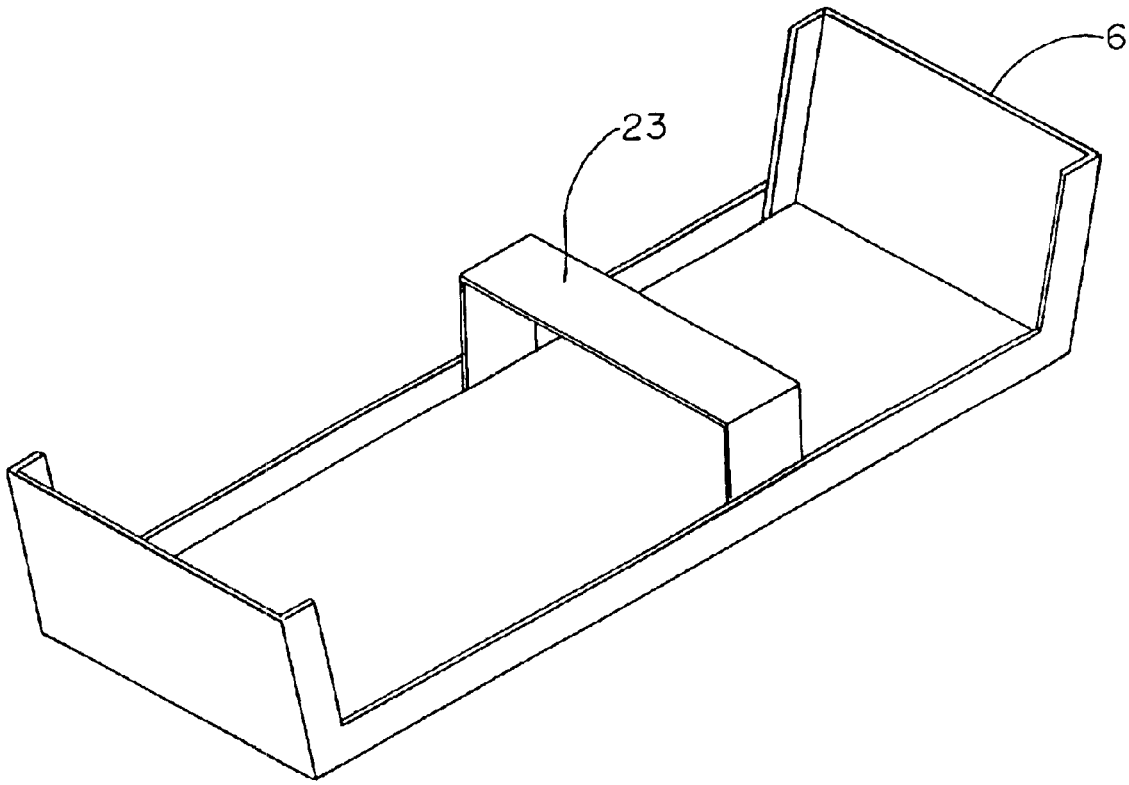
FIG. 11 is a perspective view of the small battery tray with a motor mount.

FIG. 11 illustrates the steering battery tray 6 with motor mount 23. The steering motor 12 is mounted below the steering battery tray 6 and manipulates the sprocket 11 to turn the front wheels.

Figure 12:
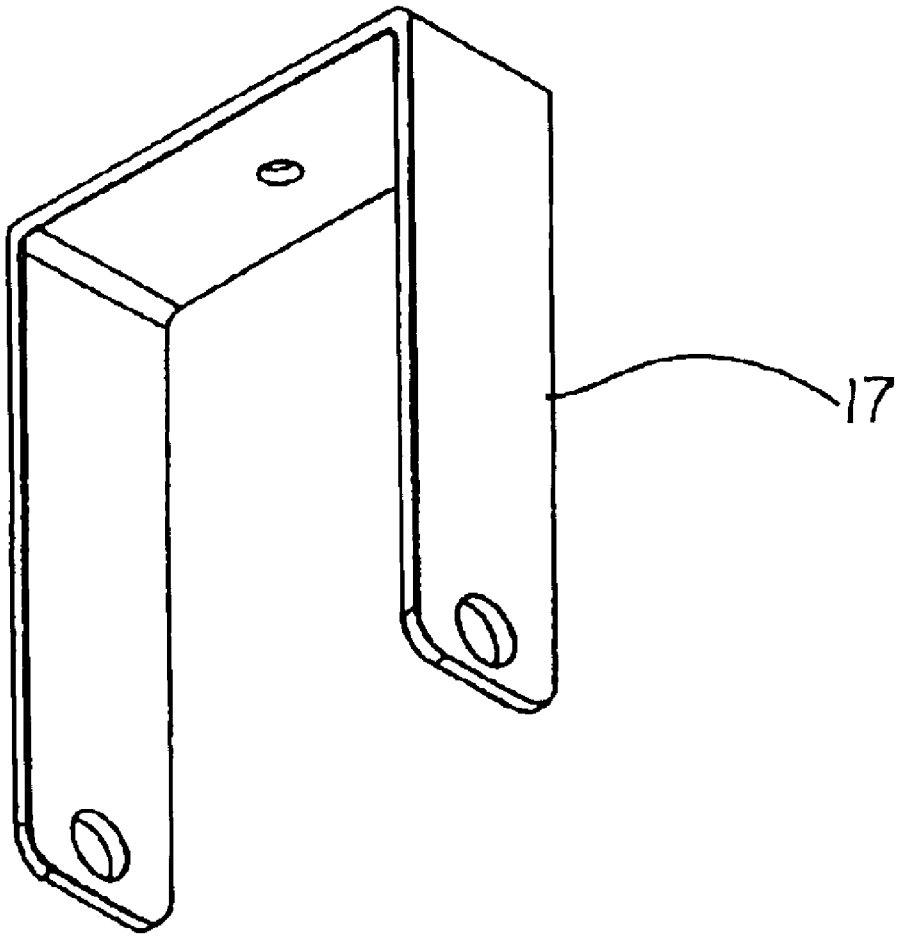
FIG. 12 is a perspective view of the front wheel forks.

FIG. 12 illustrates the front wheel forks 17. While not a part of the drive mechanism, the front wheels are attached to the front wheel forks 17, which rotate when the front wheel steering sprocket 11 is turned.

Figure 13:
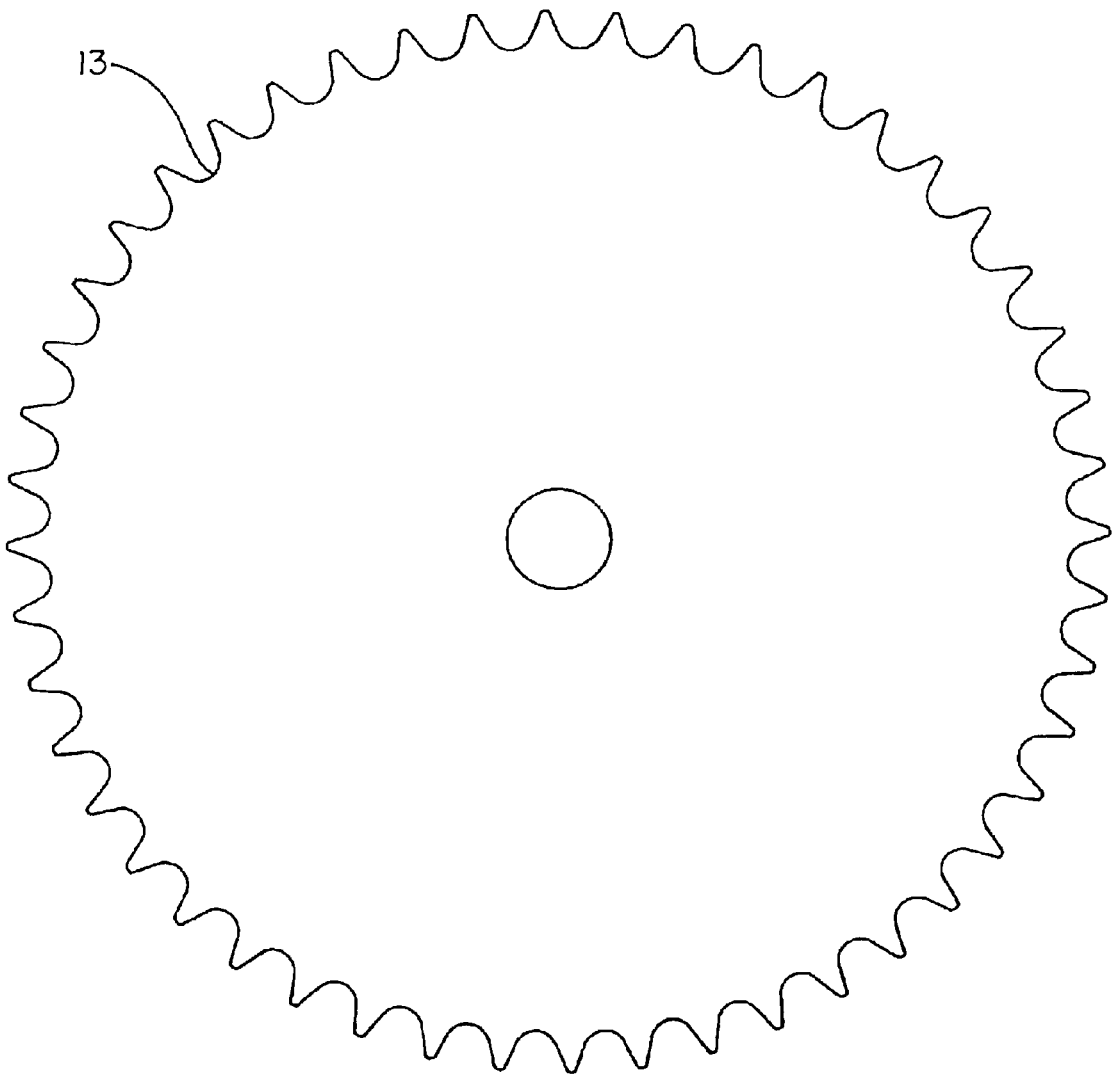
FIG. 13 is a detail of the large drive sprocket.
Figure 14:
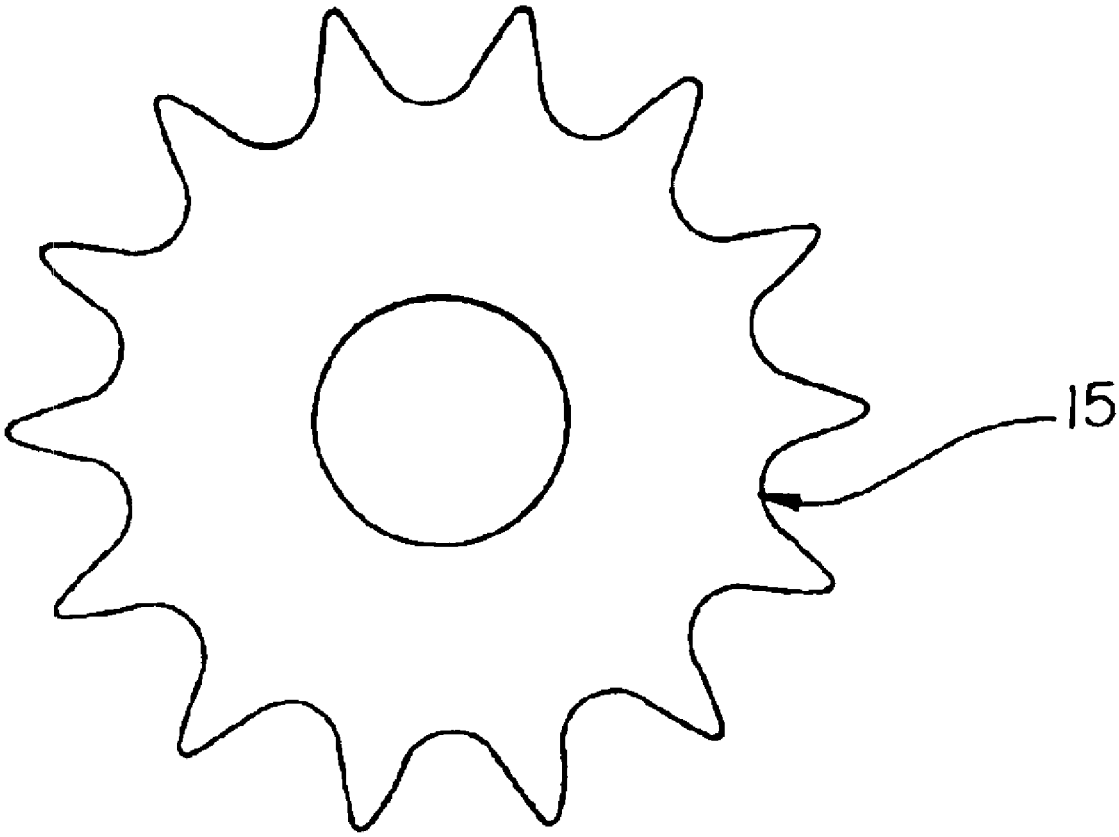
FIG. 14 is a detail of the small drive sprocket.

FIG. 13 and FIG. 14 illustrate the large drive sprocket 13 and the small drive sprocket 15 respectively.

Figure 15:
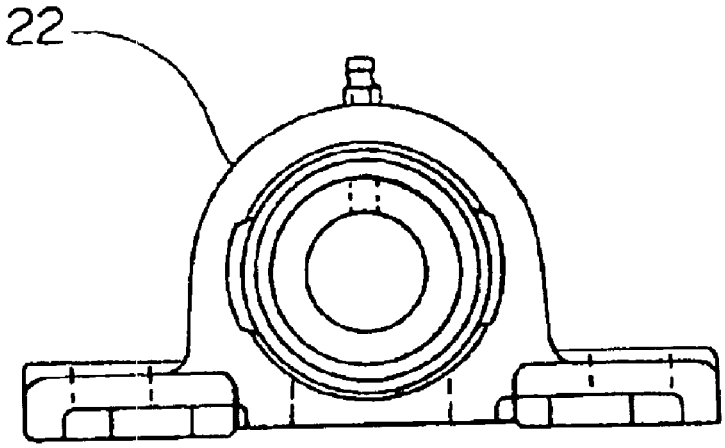
FIG. 15 is a chart and detail of the pillow blocks for the back wheels.
Figure 16:
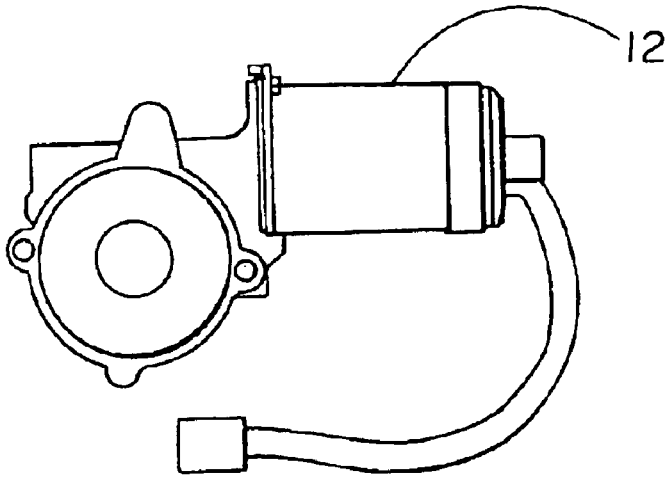
FIG. 16 is the specifications and a performance graph of the steering motor.

Example specifications of the pillow blocks 22 for the back wheels and the steering motor 12 are illustrated respectively in FIG. 15 and FIG. 16. Useful motors may also be seen at www.amequipment.com, notably the 210 series motors, such as the 210–1010. In at least one embodiment the steering motor 12 and/or the drive motor 14 are each powered by separate 12V batteries.

In at least one embodiment, the drive motor 14 may also have a clutch mechanism which engages and unengages the drive motor from communication with the large motor sprocket. In the engaged position the drive motor may power the large motor sprocket. In the unengaged position the drive motor may not power the large motor sprocket.

Figure 17:
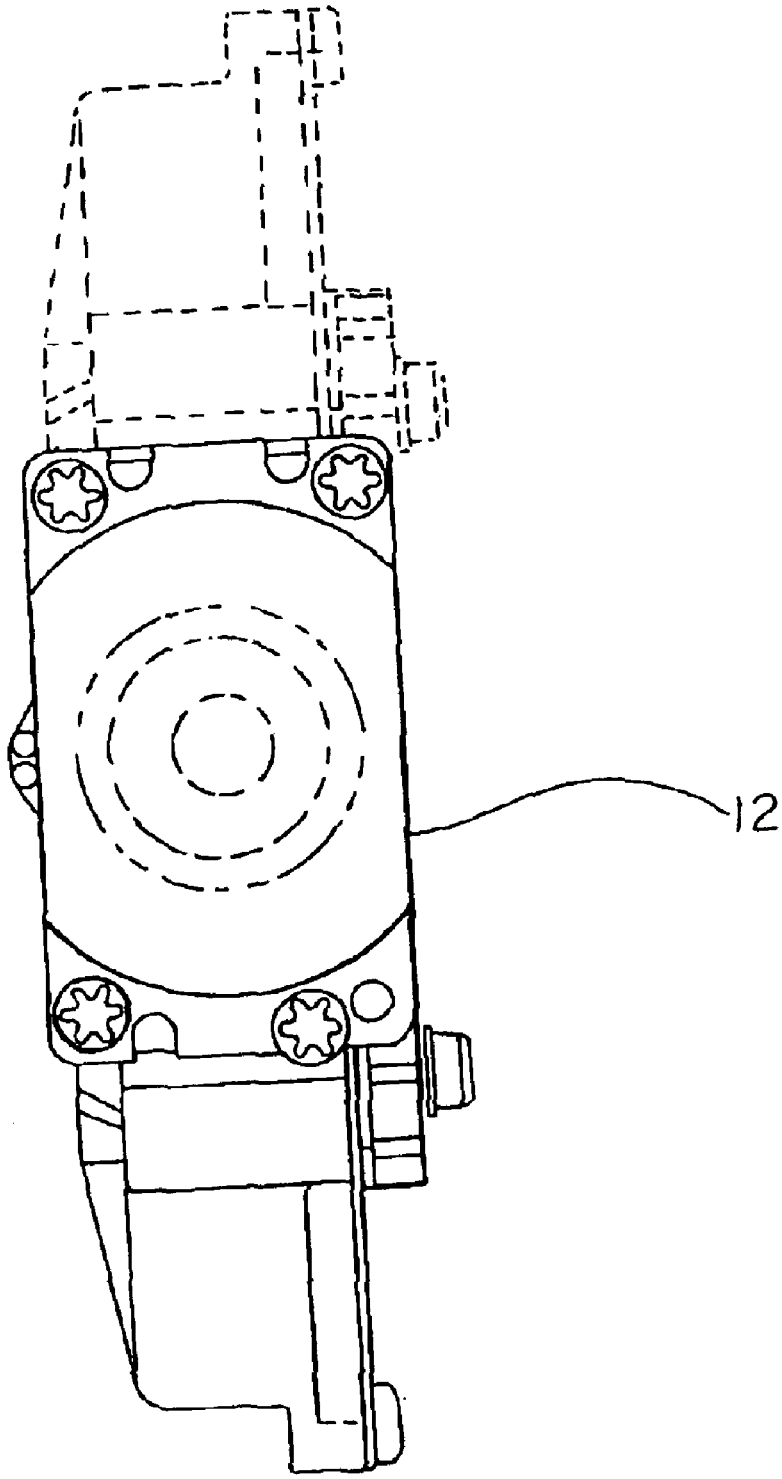
FIG. 17 is a side view of the steering motor.
Figure 18:
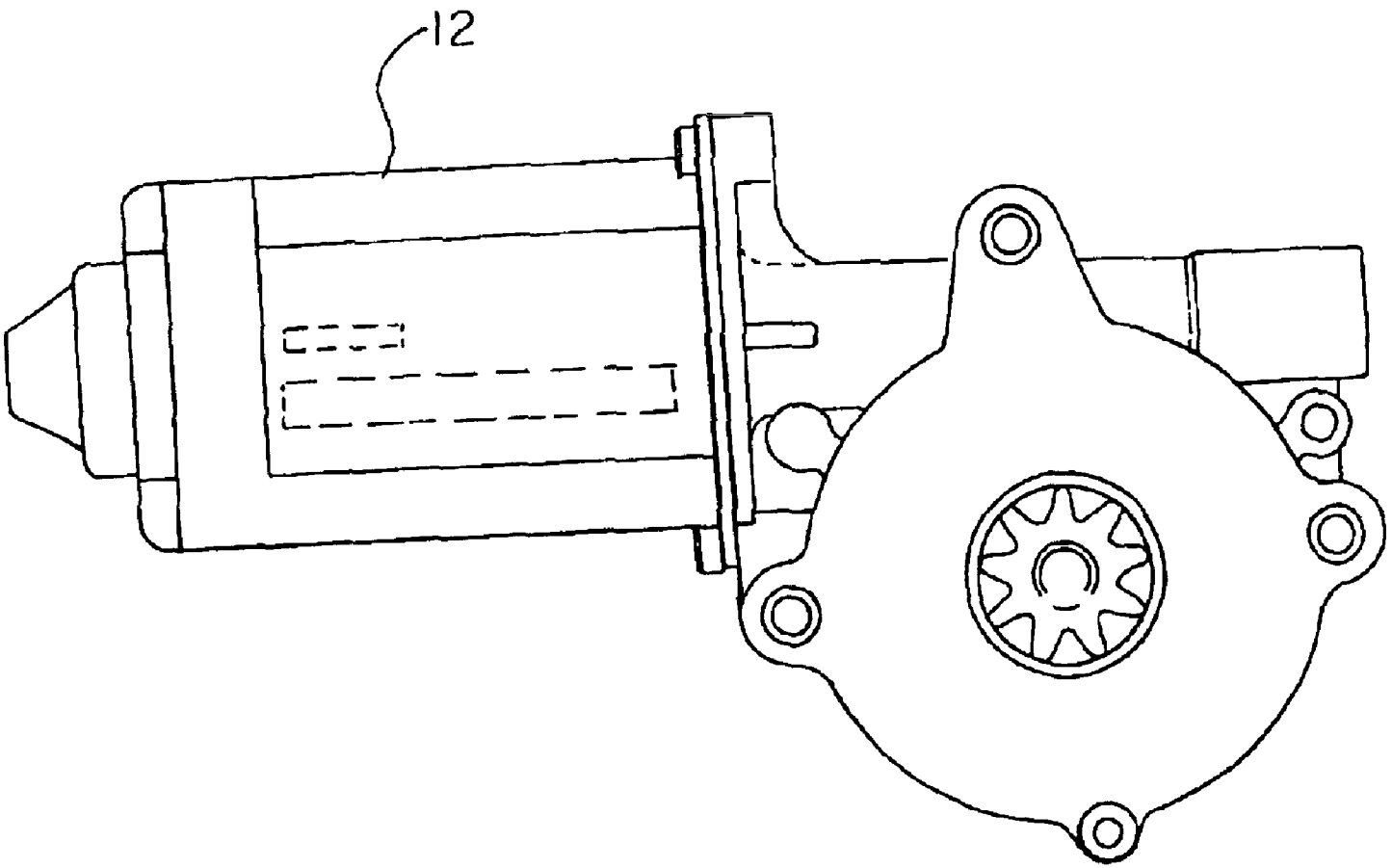
FIG. 18 is atop view of the steering motor.
Figure 19:
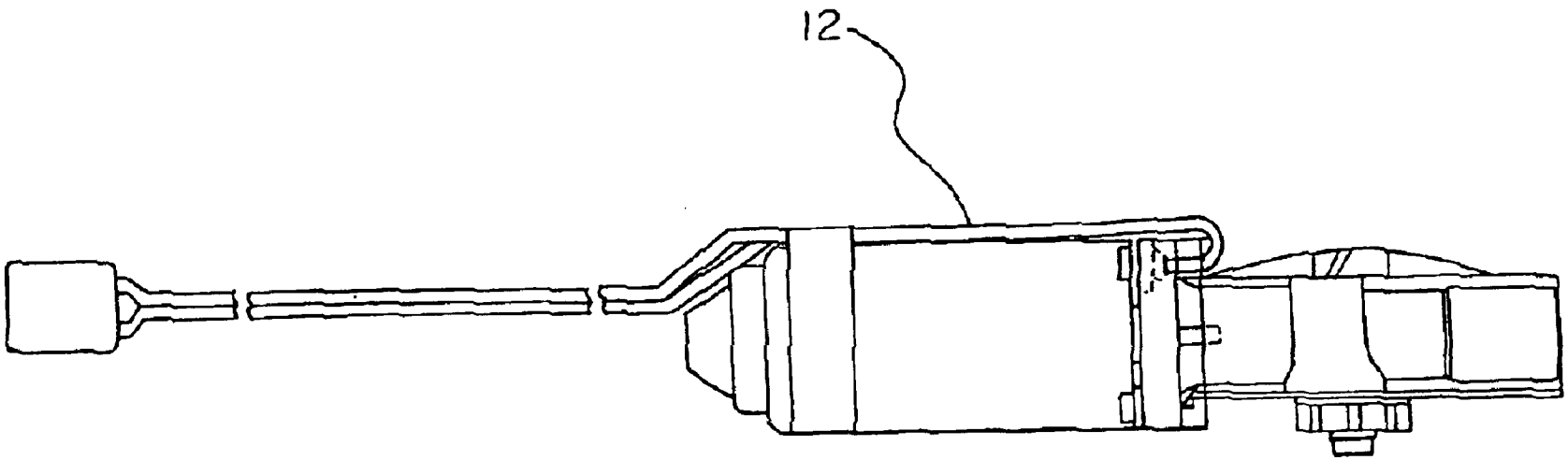
FIG. 19 is a full side view of the steering motor.

FIGS. 17–19 respectively illustrate the side, top, and full side views of the steering motor.

In at least one embodiment the scaffold vehicle has a length of between 6' and 6'6", a width of between 28" and 32", and/or a height with end rails of 6' and 6' 8". In at least one embodiment the overall assembled weight may be between about 280 to 380 lbs.

In at least one embodiment the scaffold vehicle is designed to fit through a standard sized door in a residential building. The dimensions listed are approximate and may be varied for the needs of the user. However, the dimensions do allow the user to pass through doorways without the need to disassemble and reassemble the scaffold. One need only drive the scaffold where it is needed.

The materials used are those materials which may support a person and the various materials listed above. Suitable materials include metal, such as steel, for the frame and wood or metal for the floor or planks.

All US patents and applications and all other published documents mentioned anywhere in this application are incorporated herein by reference in their entirety.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent, claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

I claim:

1. A lightweight self-propelled scaffold unit comprising: a base frame with removably attached end rails extending vertically; a drive motor battery powering a drive motor and a steering motor battery powering a steering motor; the drive motor battery and the steering motor battery separate from one another and operating on different circuits such that the drive motor is powered exclusively by the drive motor battery and the steering motor is powered exclusively by the steering motor battery; a pair of rear wheels driven by the drive motor; a pair of front wheels used in steering which are rotated by action of the steering motor.

2. A scaffold unit as in claim 1, wherein a large drive sprocket is disposed about a rear wheel axel.

3. A scaffold unit as in claim 2, wherein the large drive sprocket communicates with a small drive sprocket driven by the drive motor.

4. A scaffold unit as in claim 3, wherein the small drive sprocket communicates with the large drive sprocket via a device, the device being selected from the group consisting of a chain, belt, or a combination thereof.

5. A scaffold unit as in claim 1, wherein the drive motor is operated by a toggle switch.

6. A scaffold unit as in claim 1, wherein the steering motor is operated by a toggle switch.

7. A scaffold unit as in claim 1, wherein the drive motor and the steering motor are operated by a single toggle switch.

8. A scaffold unit as in claim 1, wherein the end rails have horizontal crossties upon which moveable platforms can be placed.

9. A scaffold unit as in claim 1 having a lowest platform level, wherein the drive motor, steering motor, drive motor battery, and/or steering motor battery are located under the lowest platform level.

10. A scaffold unit as in claim 1, the scaffold having a width between 28 and 32 inches.

11. A scaffold unit as in claim 1, wherein the base frame is made of a material chosen from the group consisting of angle iron, titanium, aluminum, steel, and composites thereof.

12. A scaffold unit as in claim 1, wherein the base frame is made of a plastic.

13. A scaffold unit as in claim 1, wherein the end rails are made of a metal from the group titanium, aluminum, steel, and composite thereof.

14. A scaffold unit as in claim 1, wherein the end rails are made of a plastic.

15. A scaffold unit as in claim 1, wherein the end rails are mated to the frame such that the ends of the end rails fit into the space of the frame.

16. A scaffold unit as in claim 1, wherein the batteries are 12V batteries.

17. A scaffold unit as in claim 1, wherein the drive motor is a 12V motor.

18. A scaffold unit as in claim 1 having a platform, the material of the platform being selected from the group consisting of metal, plastic, wood, or combination thereof.

19. A scaffold unit as in claim 1, the scaffold having a length between 6 and 6.5 feet.

20. A scaffold unit as in claim 1, wherein the base frame is constructed of material in a shape selected from the group consisting of oval, circular, rectangular, triangular, polygonal or any combination thereof.

21. A scaffold unit as in claim 1, wherein the end rails are constructed of material in a shape selected from the group consisting of oval, circular, rectangular, triangular, polygonal or any combination thereof.

22. A scaffold unit as in claim 1, wherein the drive motor comprises a switch with an on position and an off position, when the switch is in the on position and the motor communicates with a power source the drive motor can drive the small sprocket, when the switch is in the off position the motor will not drive the small sprocket.

23. A scaffold unit as in claim 1, wherein the unit includes a clutch mechanism, the clutch mechanism having an engaged and an unengaged position, in the engaged position the drive motor can power the large motor sprocket, in the unengaged position the drive motor cannot power the large motor sprocket.

24. A lightweight self-propelled scaffold unit comprising:

a base frame with removably attached end rails extending vertically;

a drive motor battery powering a drive motor and a steering motor battery powering a steering motor; the drive motor battery and the steering motor battery separate from one another and operating on different circuits such that the drive motor is powered exclusively by the drive motor battery and the steering motor is powered exclusively by the steering motor battery;

rear wheel axle having rear wheels and a large drive sprocket disposed about the rear wheel axle, the large drive sprocket communicates with a small drive sprocket driven by the drive motor action by the drive motor on the large drive sprocket rotating the rear wheel axle and rear wheels;

a pair of front wheels used in steering, rotatable by action of the steering motor;

a front wheel steering sprocket rotatable by action of the steering motor, rotation of the front wheel steering sprocket capable of moving the front wheel steering arm which turns the front wheels;

a drive motor switch with an on position and an off position, constructed and arranged such that when the switch is in the on position and the drive motor communicates with a power source the drive motor can drive the small sprocket, when the switch is in the off position the drive motor will not drive the small sprocket.

* * * * *